United States Patent [19]

Hamza et al.

[11] 4,218,012

[45] Aug. 19, 1980

[54] METHOD OF RAPIDLY DISSOLVING A PARTICULATE SUBSTANCE IN A LIQUID

[75] Inventors: Hassan A. Hamza; Jan Visman, both of Edmonton, Canada

[73] Assignee: Canadian Patents & Development, Ottawa, Canada

[21] Appl. No.: 933,551

[22] Filed: Aug. 14, 1978

[30] Foreign Application Priority Data

Sep. 1, 1977 [CA] Canada ..... 285999

[51] Int. Cl.[3] ..... B01F 3/12; B05B 1/34; B05B 7/14

[52] U.S. Cl. ..... 239/10; 239/400; 239/402; 239/405; 366/165

[58] Field of Search ..... 239/1, 7–11, 239/399, 400, 402, 403, 405, 406; 366/154, 163, 165, 176, 183

[56] References Cited

U.S. PATENT DOCUMENTS

| | | | |
|---|---|---|---|
| 1,451,063 | 4/1923 | Anthony | 239/406 |
| 3,070,317 | 12/1962 | Hunter et al. | 239/402 |

FOREIGN PATENT DOCUMENTS

| | | | |
|---|---|---|---|
| 521614 | 5/1940 | United Kingdom | 366/163 |

*Primary Examiner*—Andres Kashnikow
*Attorney, Agent, or Firm*—Francis W. Lemon

[57] ABSTRACT

A substance in a particulate form, e.g. a polyacrylamide flocculant powder, is rapidly dissolved in a liquid, e.g. water by feeding the powder down a circular bore in a casing while the water is fed tangentially and swirled in two chambers in the casing and around the circular bore to emerge in the bore, as oppositely swirling, inwardly converging streams in the path of the powder. The diverging portion of the first stream intersects the converging portion of the second stream, which goes out of the bore with the powder dissolved therein.

1 Claim, 4 Drawing Figures

METHOD OF RAPIDLY DISSOLVING A PARTICULATE SUBSTANCE IN A LIQUID

Figure 1:
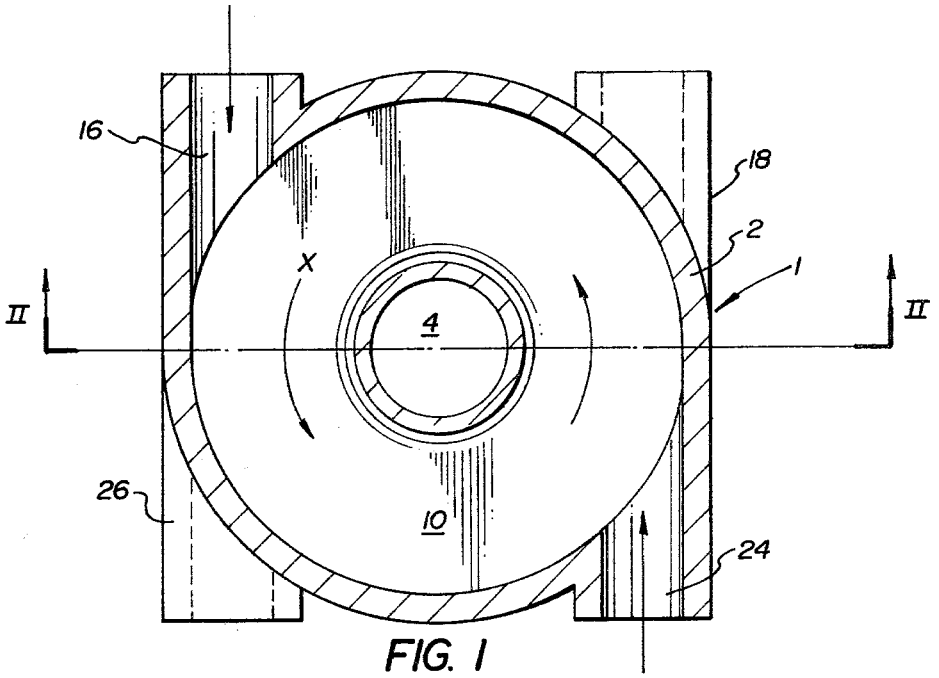

This invention relates to a method of rapidly dissolving a particulate substance in a liquid.

With, for example, water soluble, high molecular weight, long chain flocculants, such as polyacrylamide, there is a problem in that it is difficult to thoroughly wet and dissolve the whole of the flocculant in a reasonable time and if this is not done, undissolved cores of the flocculant remain. To ensure complete dissolution of these flocculants in a conventional manner can be time consuming in that it can take at least one hour, and in some cases up to three hours, under highly controlled conditions of flocculant addition and dispersion.

Thus there is a need for a method and an apparatus for rapidly wetting and dissolving water soluble, high molecular weight, long chain flocculants in a sufficiently short time and with minimum loss of the flocculant which appears in the form of undissolved cores, thereby, reducing waste of the flocculant and delay in dissolving the flocculant with concomitant savings in equipment size and capital and operating costs.

It is an object of some embodiments of the present invention to provide a method and an apparatus for rapidly wetting, dispersing and dissolving water soluble, high molecular weight, long chain flocculants in a sufficiently short time with minimum waste of the flocculant or delay in dissolving the flocculant.

While the present invention is particularly useful in dissolving water soluble, high molecular weight, long chain flocculants in solid form, it is also useful for intimately contacting other substances in particulate form with a liquid in a very rapid and remarkably well dispersed manner.

In this specification, substances in particulate form means particulate solid, liquid, gas or mixtures thereof.

According to the present invention, there is provided a method of rapidly dissolving a particulate substance in a liquid, comprising:

(a) continuously feeding the particulate substance along a path, (b) feeding liquid to a first, liquid swirling chamber to swirl therein around the path of the particulate substance, (c) feeding liquid to a second, liquid swirling chamber to swirl therein around the path of the particulate substance, (d) spraying from a first annular, outlet nozzle a first, hollow, swirling, converging stream of liquid from the swirling liquid in the first, liquid swirling chamber, from around and into a central portion of the path of, and in the direction of flow of, the particulate substance, so that the first, hollow, swirling converging stream of liquid is intimately contacted with the substance, (e) spraying from a second annular, outlet nozzle a second, hollow, swirling, converging stream of liquid from the swirling liquid in the second, liquid swirling chamber, from around and into the path of liquid from the first, hollow, swirling stream of liquid that has been intimately contacted with the particulate substance, and wherein the improvement comprises, (f) the first hollow, swirling, converging stream of liquid is swirled in an opposite direction to the second, hollow, swirling, converging stream of liquid, whereby, (g) discrete particles of the particulate substance that are intimately contacted with the first, hollow, swirling, converging stream of liquid and are subjected to very high shear and are thoroughly wetted and scrubbed to partially dissolve an outer layer and reveal new fresh surfaces, and then liquid of the second, hollow, swirling, converging stream of liquid is rapidly and intimately contacted with the newly formed, fresh surfaces on the discrete particles by subjecting the outer layer to very high shear thereby dispersing and further dissolving the outer layer.

Figure 2:
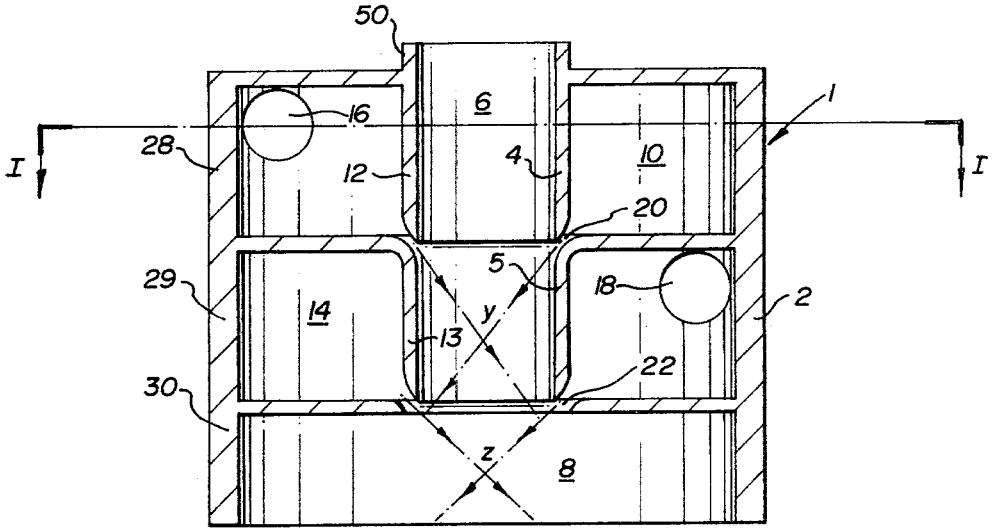
Figure 3:
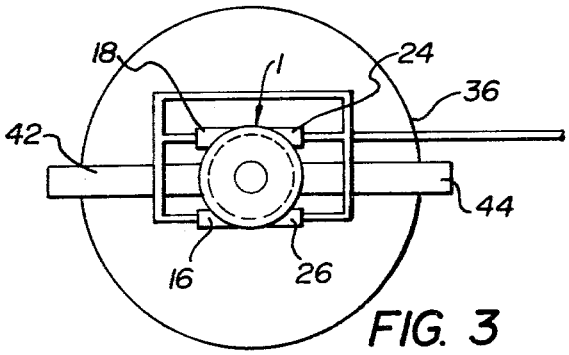
Figure 4:
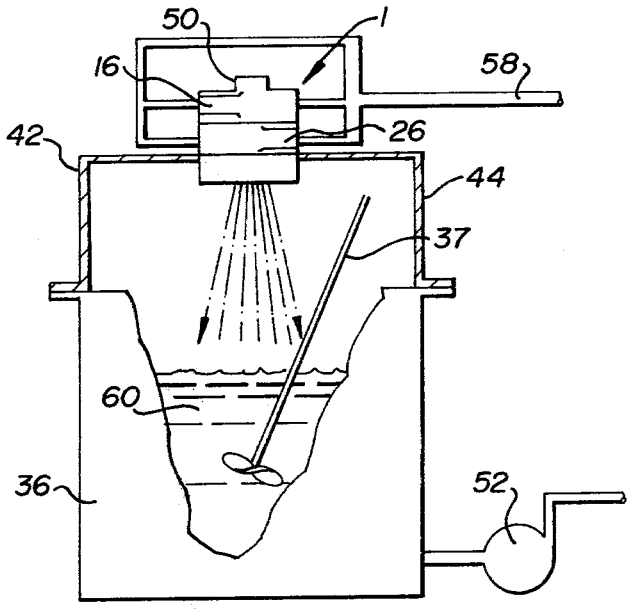

In the accompanying drawings which illustrate, by way of example, an embodiment of the present invention, FIG. 1 is a sectional plan view along I—I, FIG. 2 of an apparatus for rapidly dissolving a particulate substance in a liquid, FIG. 2 is a sectional side view along II—II, FIG. 1, FIG. 3 is a diagrammatic plan view of the apparatus shown in FIGS. 1 and 2 mounted on a tank, and FIG. 4 is a diagrammatic, partly sectioned side view of the apparatus shown in FIG. 3 connected to a pump.

Referring to FIGS. 1 and 2 there is shown an apparatus generally designated 1 which is particularly useful for disintegrating or "atomizing" for the purpose of rapidly dissolving a particulate substance in a liquid, comprising a casing 2 having a circular bore 4 forming a path for the fluid particulate substance and having an inlet end 6 for the particulate substance at one end of an intermediate portion 12 and an outlet end 8 for the substance at the other end thereof, a first, liquid swirling chamber 10 curving around the intermediate portion 12 of the circular bore 4, a second, liquid swirling chamber 14 curving around the intermediate portion 12 of the circular bore 4 at least one, in this embodiment two, substantial tangential, liquid inlets 16 and 24 to the first, liquid swirling chamber 10, for swirling liquid therein in a direction X (FIG. 1) around intermediate portion 12 of the circular bore 4, at least one, in this embodiment two substantially tangential, inlets 18 and 26 to the said second chamber 14 for swirling liquid therein, in this embodiment in the opposite direction to the direction X, around an intermediate portion 13 of the circular bore 5, a first annular, outlet nozzle 20 from the first, liquid swirling chamber 10 extending around the intermediate portion 12 of the circular bore 4 for directing a first, hollow, swirling converging stream Y (FIG. 2) of liquid into a central portion of the path of the particulate substance so that, in operation, liquid of the first, hollow, swirling converging stream of liquid will be intimately contacted with the discrete particles of the particulate substance, and a second, annular, outlet nozzle 22 from the second, liquid swirling chamber 14 and extending around circular bore 5 for directing a second, hollow, swirling, converging stream Z (FIG. 2) of liquid into the path of said first hollow, swirling, converging stream that has been intimately contacted with the discrete particles of the particulate substance.

In this embodiment of the present invention, downstream portions of the first and second liquid swirling chambers 10 and 14 preferably gradually decrease in cross-sectional area as shown in FIG. 2 towards the first and second, annular, liquid atomizing outlet nozzles 20 and 22 respectively to gradually increase the velocity of the swirling liquid in this direction.

In FIGS. 3 and 4 similar parts to those shown in FIGS. 1 and 2 are designated by the same reference numerals and the previous description is relied upon to describe them.

In FIGS. 3 and 4 the apparatus 1 is shown mounted on a tank 36 by brackets 42 and 44. A portion of the tank 36 is shown broken away to reveal its contents, including a stirrer for completing dissolution of the fluid substance.

A feed collar 50 for the particulate substance, in this instance a powdered polyacrylamide flocculant, is arranged to feed the particulate substance from a source (not shown) to the circular bore 4.

A pump 52 is provided for withdrawing the solution from the bottom of the tank 36 and delivering it to wherever the solution is required. Clean water enters the apparatus through pipe 58.

outer layer by the said first liquid stream renders the dissolved portions highly viscous. The solid particles lose a substantial portion of their kinetic energy owing to this sudden high increase in viscosity.

The second liquid stream acts to disperse and further dissolve this viscous mass of partially dissolved flocculant. In the following Table, the results of tests referred to as "Dissolved Flocculant" are from tests that were carried out using an apparatus as shown in FIGS. 1 to 4. The results of tests using a conventional stirrer are given for comparison. All of the flocculants in these tests are among the most difficult to dissolve mainly due to their very high molecular weights.

| FLOCCULANT CHARACTERISTICS | | | | | | DISSOLUTION | | | | | |
|---|---|---|---|---|---|---|---|---|---|---|---|
| | | | | | | ATOMIZATION | | | STIRRING | | |
| Trade Name | Supplier | Substance | Ionic Nature | Molecular Weight ($\times 10^6$) | Concentrations Grams/lit | Feed Rate gm/sec | Dissolution Time | Viscosity CP | Feed Rate gm/sec | Dissolution Time | Viscosity CP |
| Separan MG700 | Dow Chemical Co. Michigan Midland U.S.A. | Polyacrylamide | Anionic | (3-5) | 1.0 | 2 | 0 to 2 secs | 10.64 | 0.05 | 30 mins. | 11.93 |
| Separan MG700 | Dow Chemical Co. Michigan Midland U.S.A. | Polyacrylamide | " | " | 2.0 | 4 | 0 to 2 secs | 61.3 | 0.08 | 30 mins. | 48.08 |
| Hercofloc 819.2 | Hercules Inc. | Polyacrylamide | " | (8-10) | 1.0 | 2 | 0 to 2 secs | 25.31 | 0.025 | 30 mins. | 21.98 |
| Hercofloc 81.9. 2 | Hercules Inc. | Polyacrylamide | " | " | 2.0 | 4 | 0 to 2 secs | 108.91 | 0.04 | 30 mins. | 100.97 |

*Viscosity of the flocculant solution depends on:
(1) Molecular weight of the flocculant (it goes up with increasing molecular weight).
(2) Concentration of the flocculant (the higher the flocculant concentration in solution, the higher the viscosity).
(3) Degree of dissolution of the flocculant (viscosity is higher for higher degrees of dissolution). For the same flocculant and at the same concentration, the viscosity can be considered proportional to the degree of dissolution.

In operation the apparatus is arranged as shown in FIGS. 1 and 4 and the tank 36 (FIGS. 3 and 4) is partly filled with water 60. Referring to FIG. 1, water enters through inlets 16, 18, 24, 26 while a polyacrylamide flocculant is fed into the inlet end of the circular bore 4.

Referring to FIG. 2, the first, hollow, swirling, converging stream of water is shown by arrows Y while the second, hollow, swirling, converging stream of water is shown by arrows Z.

The particles of the polyacrylamide flocculant enter through the feed collar 50 into inlet end 6 and fall into the said first, swirling converging stream of water Y and are instantaneously subjected to very high shear. This very high shear has the effect of thoroughly wetting, scrubbing and dissolving the polyacrylamide particles. The partially dissolved particulate substance is then subjected to a very high shear in the same manner by said second, hollow, swirling, converging stream of water Z. The time required to dissolve solid polyacrylamide flocculant by conventional processes averages one hour, and in some instance up to three hours, while in tests to verify the process according to the present invention this was accomplished with a much greater feed rate and greatly reduced dissolution time.

It should be noted that with particles of a polyacrylamide flocculant the first wetting and dissolving of an While the apparatus has been shown with two, substantially tangential inlets to each liquid swirling chamber, it is within the scope of the present invention for each liquid swirling chamber to have one, three or more substantially tangential inlets.

It is also within the scope of the present invention to have three or more swirling chambers with substantially tangential inlets to produce alternately oppositely swirling, inwardly converging streams of liquid arranged in a similar manner to the two streams described above.

In some embodiments of the present invention the pump 52 (FIG. 4) circulates the water 60 through the pipe 58 where it is advantageous to do this.

We claim:

1. A method of rapidly dissolving a particulate substance in a liquid, comprising:

(a) continuously feeding the particulate substance along a path, (b) feeding liquid to a first, liquid swirling chamber to swirl therein around the path of the particulate substance, (c) feeding liquid to a second, liquid swirling chamber to swirl therein around the path of the particulate substance, (d) spraying from a first annular, outlet nozzle a first, hollow, swirling, converging stream of liquid from the swirling liquid in the first, liquid swirling chamber from around and into a central portion of the path of, and in the direction of flow of, the particulate substance, so that the first, hollow, swirling converging stream of liquid is intimately contacted with the particulate substance, and (e) spraying from a second annular, outlet nozzle a second, hollow, swirling, converging stream of liquid from the swirling liquid in the second, liquid swirling chamber, from around and into the path of liquid from the first, hollow, swirling stream of liquid that has been intimately contacted with the particulate substance, and (f) wherein the improvement comprises, the first hollow, swirling, converging stream of liquid is swirled in an opposite direction to the second, hollow, swirling, converging stream of liquid, whereby, (g) discrete particles of the particulate substance that are intimately contacted with the first, hollow, swirling, converging stream of liquid and subjected to very high shear and are thoroughly wetted and scrubbed to partially dissolve an outer layer and reveal new fresh surfaces, and then liquid of the second, hollow swirling, converging stream of liquid is rapidly and intimately contacted with the newly formed, fresh surfaces on the discrete particles by subjecting the outer layer to very high shear thereby dispersing and further dissolving the outer layer.

* * * * *